US008436272B2

(12) United States Patent
Schiebout

(10) Patent No.: US 8,436,272 B2
(45) Date of Patent: May 7, 2013

(54) SYSTEMS AND METHODS TO POSITION WEB PROCESSING EQUIPMENT

(75) Inventor: David Schiebout, Brainerd, MN (US)

(73) Assignee: Delta Industrial Services, Inc., Minneapolis, MN (US)

( * ) Notice: Subject to any disclaimer, the term of this patent is extended or adjusted under 35 U.S.C. 154(b) by 1410 days.

(21) Appl. No.: 12/058,335

(22) Filed: Mar. 28, 2008

(65) Prior Publication Data

US 2009/0242602 A1 Oct. 1, 2009

(51) Int. Cl.
*B23K 26/00* (2006.01)

(52) U.S. Cl.
USPC ..... 219/121.6; 219/121.78; 226/200

(58) Field of Classification Search ..... 219/121.6, 219/121.78, 121.67, 121.84, 121.82; 483/31, 483/34, 44, 46; 409/34, 146; 29/563, 564; 226/1, 53, 200
See application file for complete search history.

(56) References Cited

U.S. PATENT DOCUMENTS 3,764,775 A * 10/1973 Hasslinger et al. ..... 219/121.67
4,572,683 A * 2/1986 Hayashi ..... 400/208
4,673,075 A * 6/1987 Ueyama et al. ..... 198/339.1
4,866,238 A * 9/1989 Karube ..... 219/121.78
5,054,355 A * 10/1991 Tisse et al. ..... 83/879
5,641,265 A * 6/1997 Spada et al. ..... 414/779
5,961,858 A * 10/1999 Britnell ..... 219/121.78
6,153,853 A * 11/2000 Maruyama et al. ..... 219/121.81
6,722,959 B2 * 4/2004 Opfer ..... 451/65
6,764,434 B1 * 7/2004 Volk ..... 483/36
7,013,749 B2 * 3/2006 Uno ..... 74/490.01
2001/0041651 A1 * 11/2001 Abe et al. ..... 483/3
2002/0153358 A1 * 10/2002 Inoue et al. ..... 219/121.6
2003/0154695 A1 * 8/2003 Samborn et al. ..... 53/556
2004/0108305 A1 * 6/2004 Harnisch et al. ..... 219/121.72
2005/0087518 A1 * 4/2005 Hessbruggen et al. .... 219/121.6
2005/0204595 A1 * 9/2005 Gourash et al. ..... 40/316

FOREIGN PATENT DOCUMENTS

EP 1810944 A1 * 7/2007

* cited by examiner

*Primary Examiner* — Geoffrey S Evans
(74) *Attorney, Agent, or Firm* — Schwegman, Lundberg & Woessner, P.A.

(57) ABSTRACT

Various method embodiments move web equipment from a first web processing station to a second web processing station. According to a method embodiment, the web equipment is raised away from the first web processing station, where raising includes rotating the web equipment about a rotary axis. The rotary axis is linearly moved along a linear axis. The web equipment is lowered toward the second web processing station, wherein lowering includes rotating the web equipment about the rotary axis. Various embodiments move a laser head from one web processing station into operational position at another web processing station.

22 Claims, 14 Drawing Sheets

SYSTEMS AND METHODS TO POSITION WEB PROCESSING EQUIPMENT

TECHNICAL FIELD

This application relates generally to web processing machines and, more particularly, to machine-mountable positioning apparatus for web processing equipment on multi-station web processing machines.

BACKGROUND

Web processing refers to numerous operations related to manipulating a continuous stream of product. Web processing machines perform web processing to produce a finished product from a continuous flow of material often loaded onto the machine in the form of a roll of material. The value of a web processing machine is often measured by the versatility of the machine. Versatility is manifest in how quickly the machine can be converted to run a different product, the number of different products a machine can produce, the speed at which the machine produces a particular product or combination thereof. One of the limits to machine versatility is whether a particular piece of web processing equipment mounted on a machine is positioned correctly for variations of a product or different products not originally anticipated to be produced by the machine. Large web processing equipment can limit the versatility of a web processing machine because the equipment cannot be easily moved from one web processing station of a machine to another to produce other products.

SUMMARY

Various apparatus embodiments comprise a linear axis, a carriage, a rotary axis, and a mount. The linear axis is mounted to a web processing machine. The carriage is adapted to linearly move on the linear axis. The rotary axis is connected to the carriage. The mount is connected to the rotary axis, and is adapted to mount web processing equipment to process web. Various embodiments include a controller adapted to move the mount between at least two web processing stations on the web processing machine using the linear and rotary axes.

Various system embodiments guide a laser beam to a laser head to process web handled by a web processing machine. The system comprises a positioning apparatus mounted to the web machine and adapted to move the laser head from one web processing station into operational position at another web processing station. The positioning apparatus comprises a linearly movable carriage, a mount rotatably coupled to the carriage, and a mirror mounted to the carriage and in a path of the laser beam. The mirror is adapted to direct the laser beam to the mount, and the mount is adapted to direct the laser beam to the laser head coupled to the mount.

Various method embodiments move web equipment from a first web processing station to a second web processing station. According to a method embodiment, the web equipment is raised away from the first web processing station, where raising includes rotating the web equipment about a rotary axis. The rotary axis is linearly moved along a linear axis. The web equipment is lowered toward the second web processing station, wherein lowering includes rotating the web equipment about the rotary axis.

Various method embodiments disengage one or more axis brakes of a positioning apparatus having one or more axes, disengage a positioning pin to unlock one of the one or more axes, implement a motion profile to avoid interferences moving the web processing equipment from the first web processing station to the second web processing station, execute a plurality of moves of the one or more axes according to the motion profile, engage the positioning pin to lock one of the one or more axes, and engage one or more axis brakes of the positioning apparatus.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their legal equivalents.

DETAILED DESCRIPTION

Figure 1A:
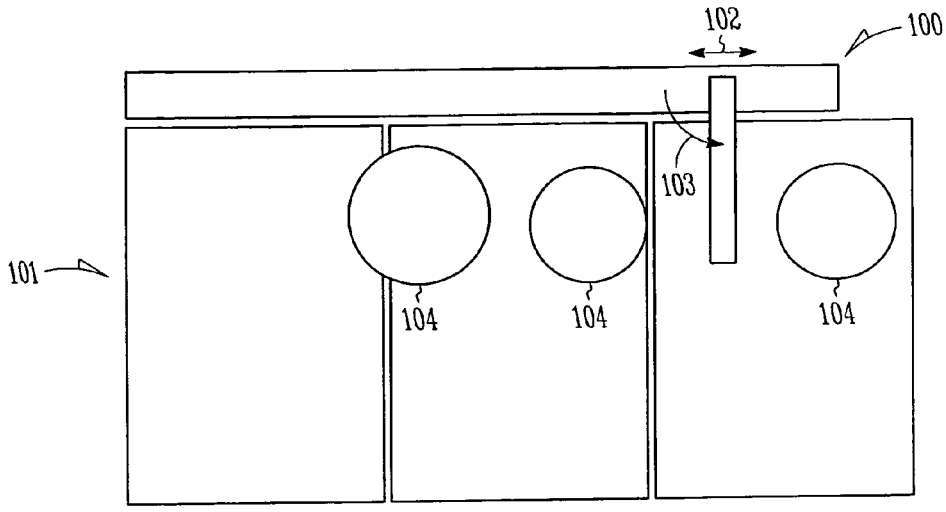
FIGS. 1A-1G illustrate a positioning apparatus for web processing equipment according to an embodiment of the present subject matter.
Figure 1B:
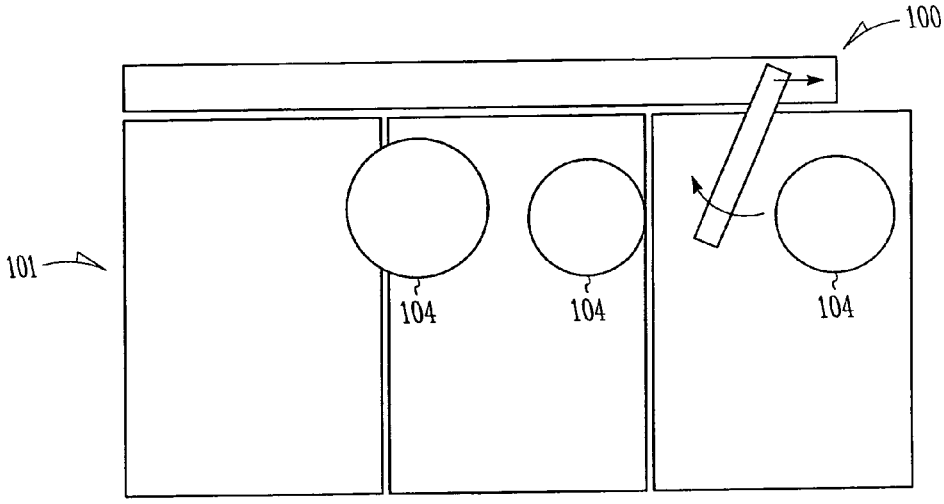
Figure 1C:
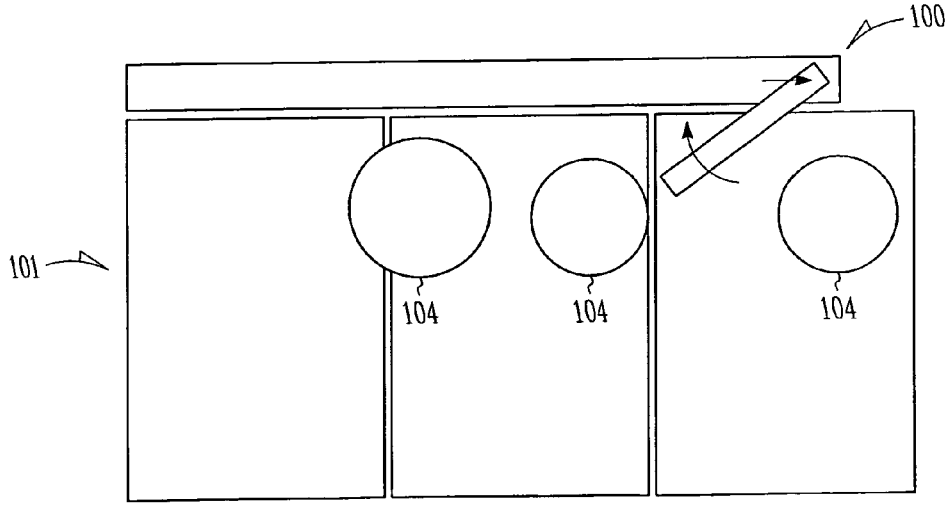
Figure 1D:
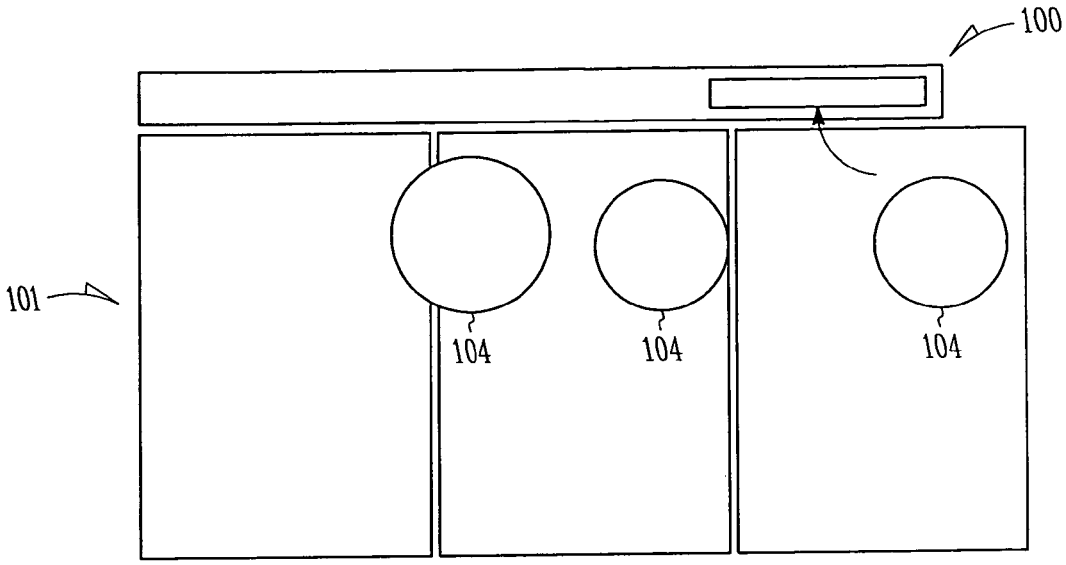
Figure 1E:
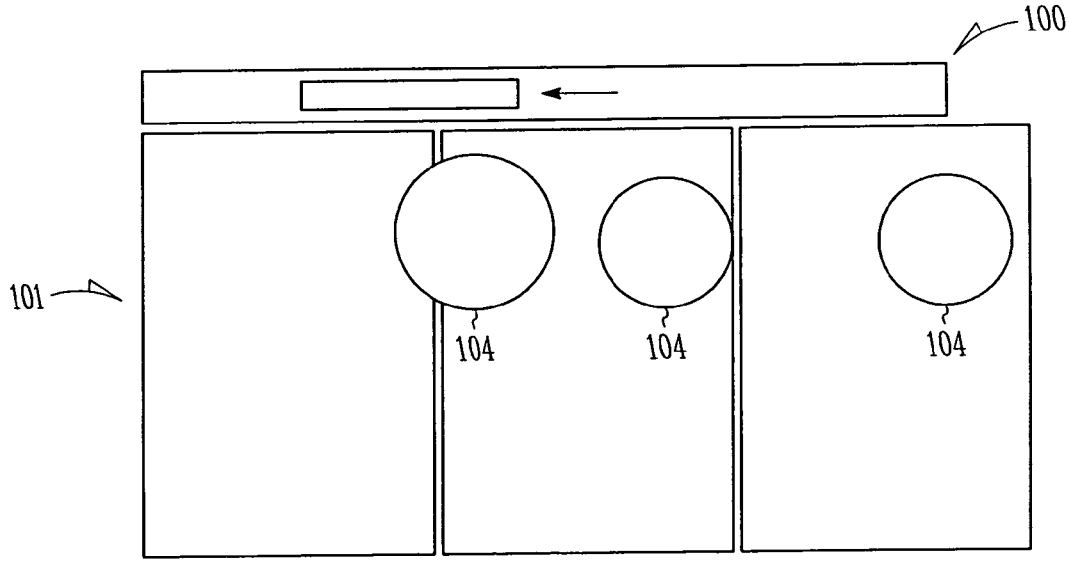
Figure 1F:
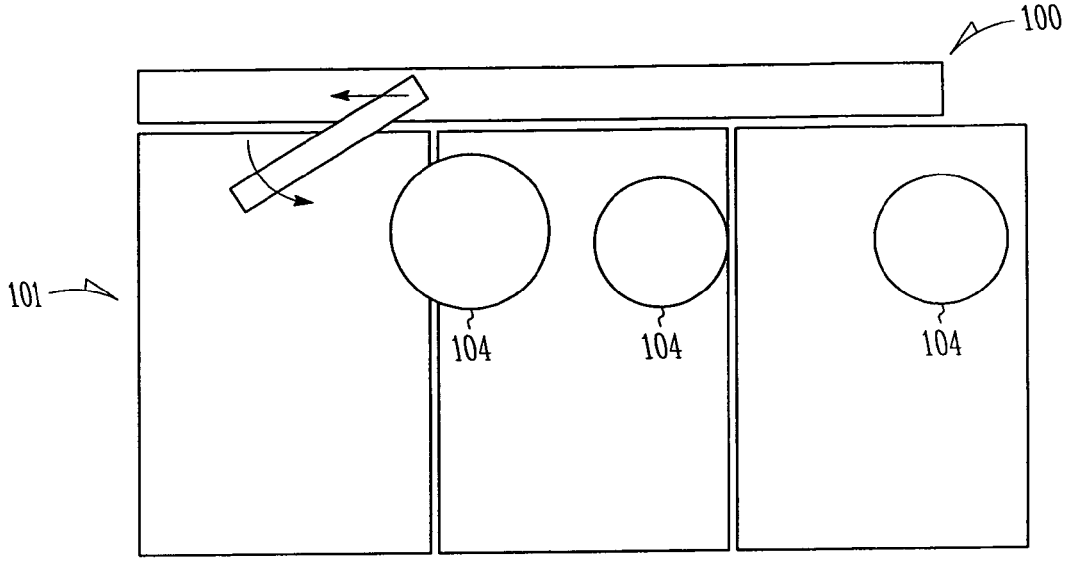
Figure 1G:
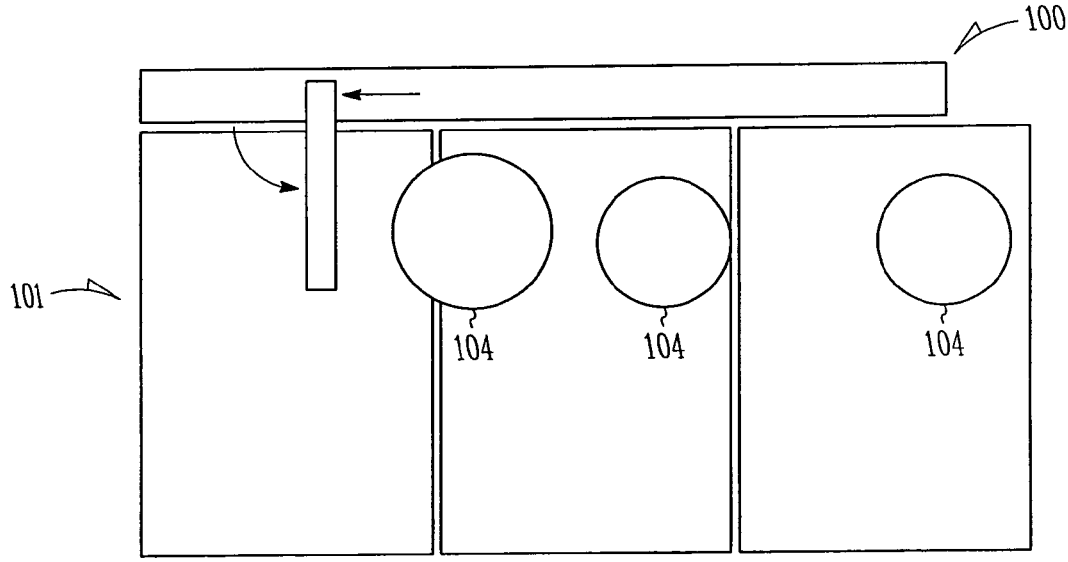

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

FIGS. 1A-1G illustrate a positioning apparatus 100 for web processing equipment according to an embodiment of the present subject matter. In various applications, the positioning apparatus 100 is mounted atop a web processing machine 101. The positioning apparatus 100 provides horizontal positioning 102 of web processing equipment across the face of the web processing machine using a linear axis. The positioning apparatus allows web processing equipment normally fixed mounted to a web processing machine to be portable with respect to web processing stations positioned across the face of the web processing machine. In various embodiments, the positioning apparatus includes a rotational axis to rotate, as represented by arrows 103, a mount for the web processing equipment, or a portion of the web processing equipment, vertically out of the way of interferences positioned across the face of the web machine. Once the mount/web processing equipment is raised (e.g. FIG. 1D), the mount/web processing equipment is horizontally moved toward the new station (e.g. FIG. 1E) and rotated to lower the mount/web processing equipment into operational position to process web at the new station (e.g. FIG. 1G). In various embodiments, a controller is preprogrammed with positions detailing areas of potential interference 104 for the positioning apparatus 100. The controller includes programming to control the motion of the positioning apparatus between one or more web processing stations. In various embodiments, the controller includes programming to combine the movement of the horizontal motion and the rotational motion to avoid the preprogrammed areas of potential interference while moving the web processing equipment from one station to another.

Figure 2:
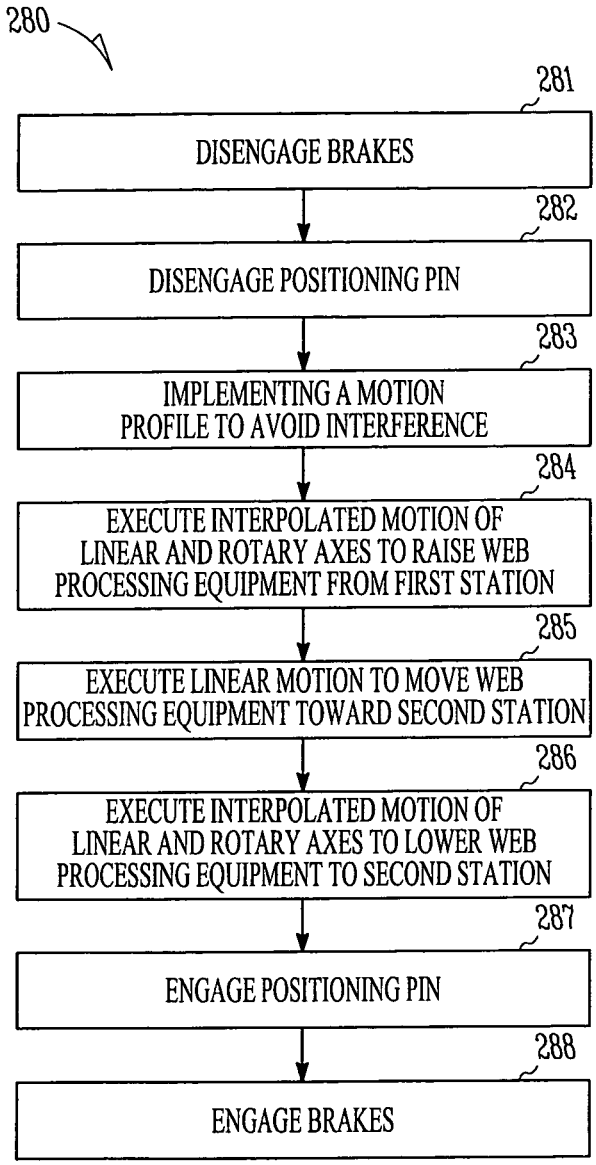
FIG. 2 illustrates a flow diagram for using a positioning apparatus to move web processing equipment from one web processing station to another station according to an embodiment of the present subject matter.

FIG. 2 illustrates a flow diagram for using a positioning apparatus to move web processing equipment from one web processing station to another station according to an embodiment of the present subject matter. The illustrated process 280 includes disengaging linear axis motor brake 281, disengaging a positioning pin (or other mechanical locking mechanism) to allow rotary motion of the positioning apparatus 282, implementing a motion profile of the web processing equipment to avoid interferences 283, executing one or more interpolated moves of a linear axis and a rotary axis to raise the web processing equipment from a first station 284, executing a linear move to move the web processing equipment toward a second station 285, executing one or more interpolated moves of the linear and rotary axes to lower the web processing equipment at the second station 286, engaging the positioning pin 287 and engaging linear axis motor brake 288. In various embodiments, implementing a motion profile 283 includes determining a motion path from previously mapped areas of potential interference. Some embodiment use sensor (s) adapted to sense potential interference, and control motion based on the sensed potential interference as determined using the sensor(s).

Figure 3:
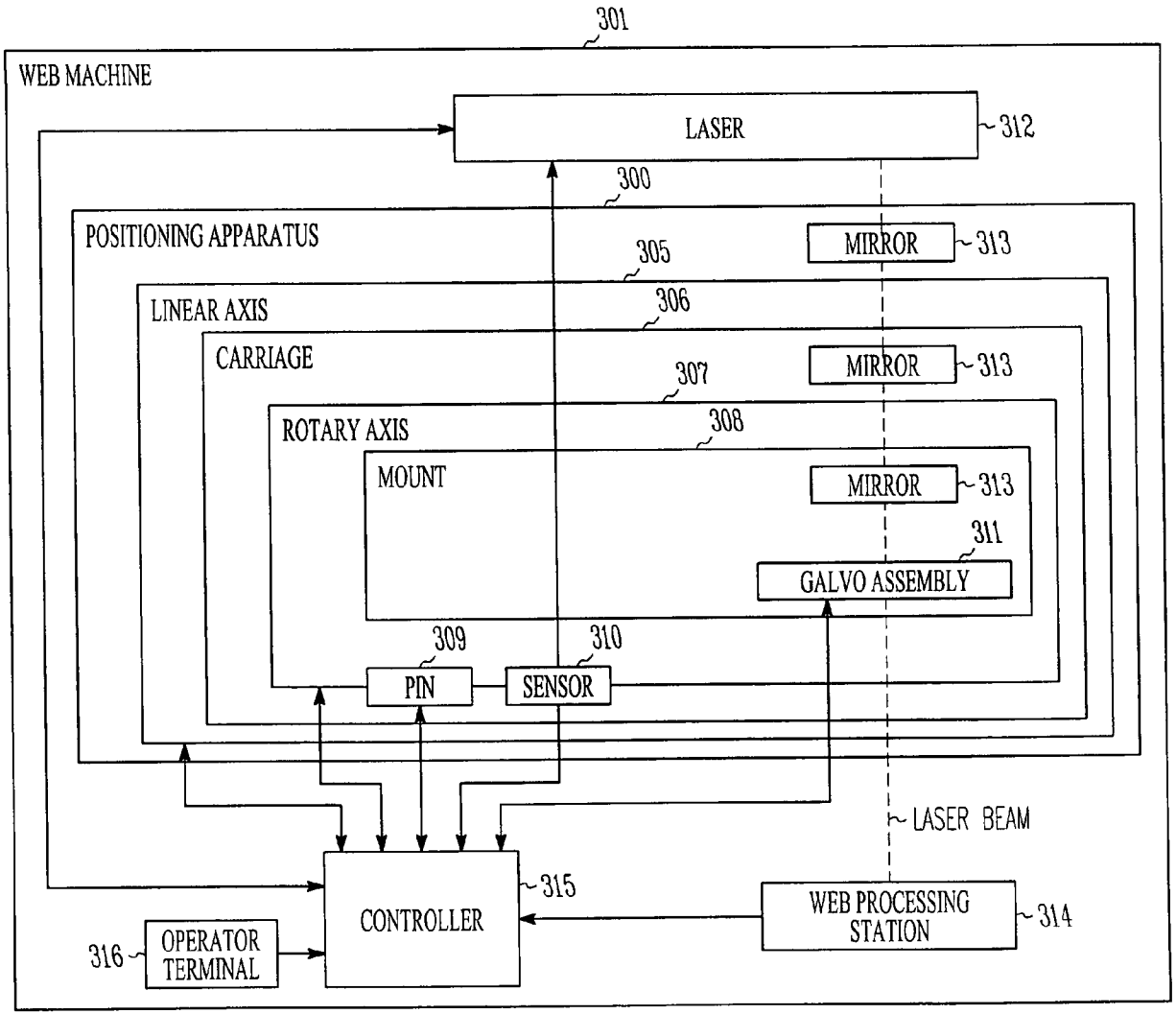
FIG. 3 illustrates a block diagram of a positioning apparatus for laser processing equipment mounted to a web machine according to an embodiment of the present subject matter.

FIG. 3 illustrates a block diagram of a positioning apparatus 300 for laser processing equipment mounted to a web machine 301 according to an embodiment of the present subject matter. The positioning apparatus 300 includes a linear axis 305, a carriage 306, a rotational axis 307, a mount 308 for mounting web processing equipment, a positioning pin 309 and a position sensor 310. The positioning apparatus provides mobility to web processing equipment normally mounted in a fixed position on a web processing machine. In various embodiments, providing mobility to normally fixed web processing equipment allows a web processing machine to produce a greater variety of products, processes or combination thereof.

The linear axis 305 of the positioning apparatus 300 includes a fixed portion for mounting to a web processing machine 301. The carriage 306 linearly moves along the linear axis. The rotary axis 307, the positioning pin 309 and the position sensor 310 are coupled to the carriage. The mount 308 is coupled to the rotary axis 307. In the illustrated embodiment, a laser galvo assembly 311 is coupled to the mount 308. The laser galvo assembly 311 is a component of laser processing equipment for web processing. Various laser galvo assemblies can be mounted to the positioning apparatus. In general, a laser galvo assembly includes one or more galvanometer mechanisms for moving one or more mirrors to direct a laser beam in a predetermined pattern toward a target, such as web on a web processing machine. Laser web processing equipment can provide a variety of web processing functions, such as intricate cutting, control depth cutting, scoring, ablation or combinations thereof. In the illustrated embodiment, a laser 312 is fixed to the web processing machine. The positioning apparatus 100 guides the laser beam from the laser 312 to the galvo assembly 311 coupled to the mount 308 using a set of mirrors 313. As the galvo assembly 311 is moved from one processing station 314 of the web processing machine to another, a controller 315 coordinates the motion of the linear 305 and rotary 307 axes to avoid other equipment mounted to the face of the web processing machine 301. For example, web processing machines often include a plurality of web spindles and idler rolls, as well as other parts, mounted to the face of the web processing machine.

In various embodiments, the positioning pin 309 engages when the positioning apparatus 300 completes a positioning move and disengages just prior to beginning a positioning operation. The positioning pin 309 locks the mount 308 connected to the rotary axis 307 at the completion of a positioning operation. In various embodiments, the position sensor 310 provides a permissive signal to the controller verifying proper positioning of the rotary axis. In various embodiments, the position sensor provides a permissive signal to the attached web processing equipment verifying proper positioning of the rotary axis. In the illustrated embodiment, the sensor 310 is connected to both the controller 315 and the laser 312. The controller 315 uses the permissive signal to enable or disable the web processing equipment moved using the positioning apparatus 300. For example, in the illustrated embodiment, the position sensor signal is used to enable the laser 312 only when the rotary axis 307 is positioned within a limited range of motion detected using the sensor 310.

Figure 10:
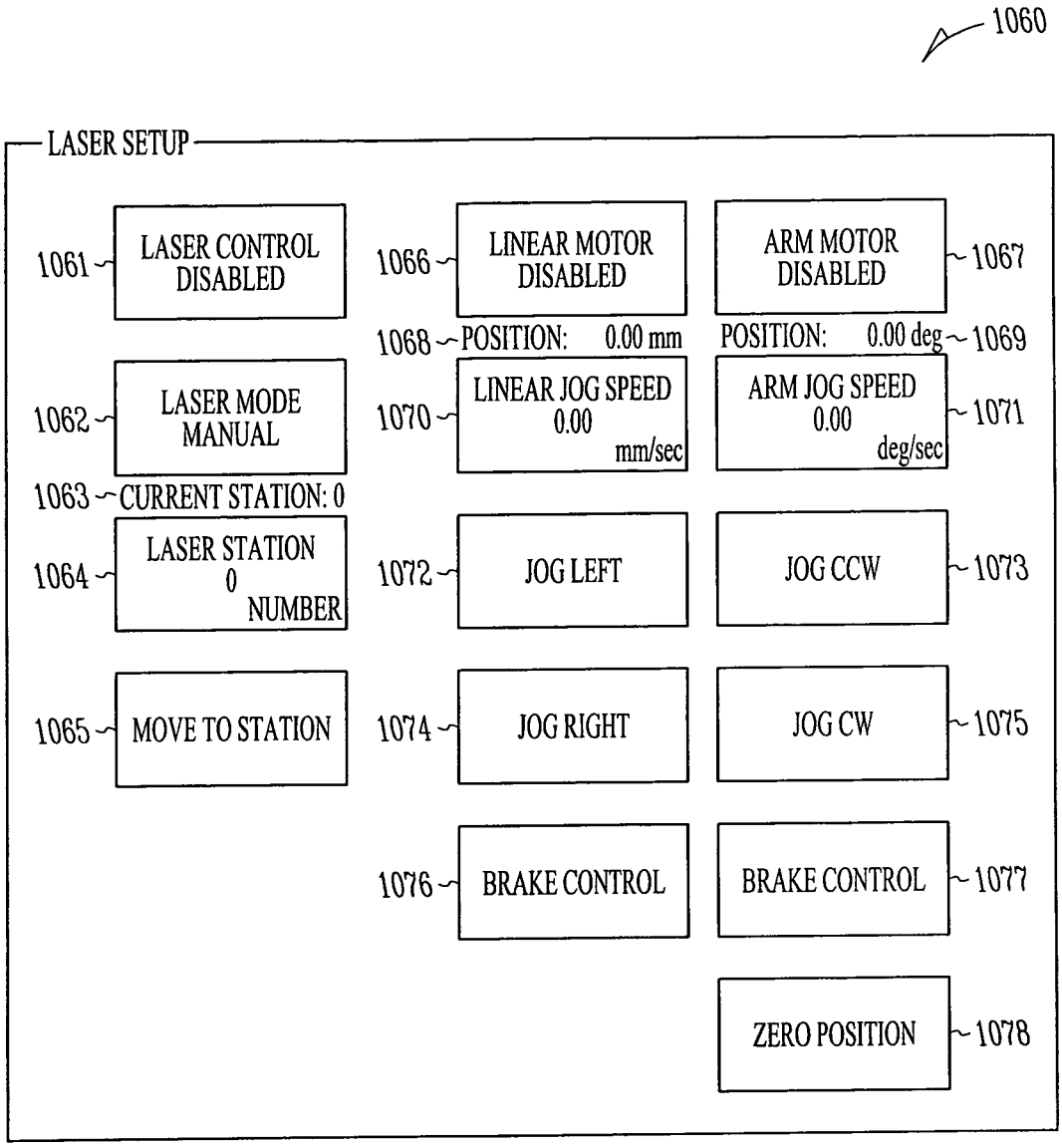
FIG. 10 illustrates a operator terminal screen 1060 for controlling a positioning apparatus and attached web processing equipment according to one embodiment of the present subject matter.

In various embodiments, an operator terminal 316 is connected to the controller 315 and provides status information about the positioning apparatus 300 and the web processing equipment. Some operator terminal embodiments provide an interface for a user to control the positioning apparatus 300, for example, to manually move the axes of the positioning apparatus, manually control the positioning pin, manually control one or more motor brakes, change the operating mode of the positioning apparatus or combination thereof. An example of an operator terminal screen is illustrated in FIG. 10.

Figure 4A:
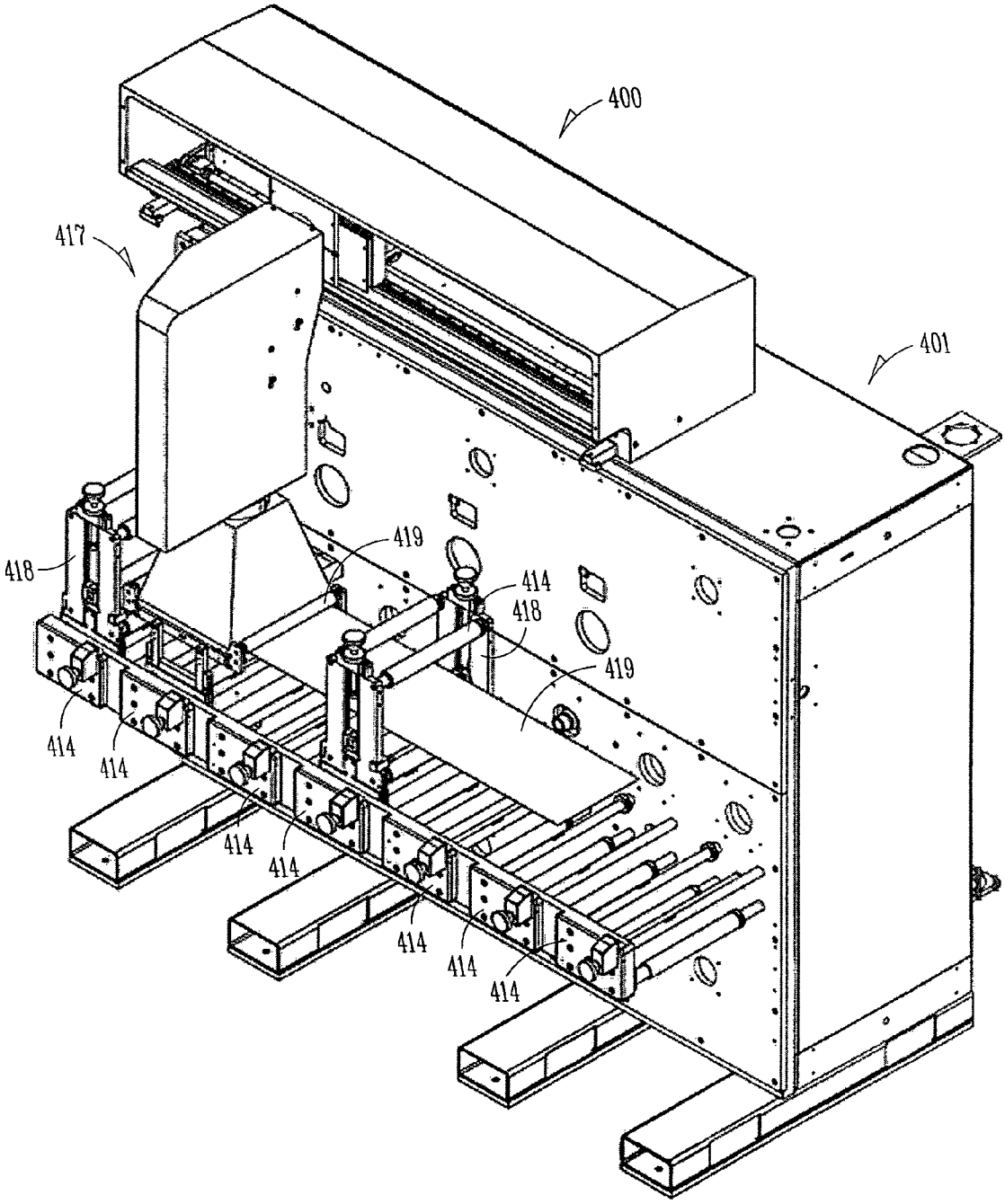
FIGS. 4A-4B illustrate a positioning apparatus according to an embodiment of the present subject matter.
Figure 4B:
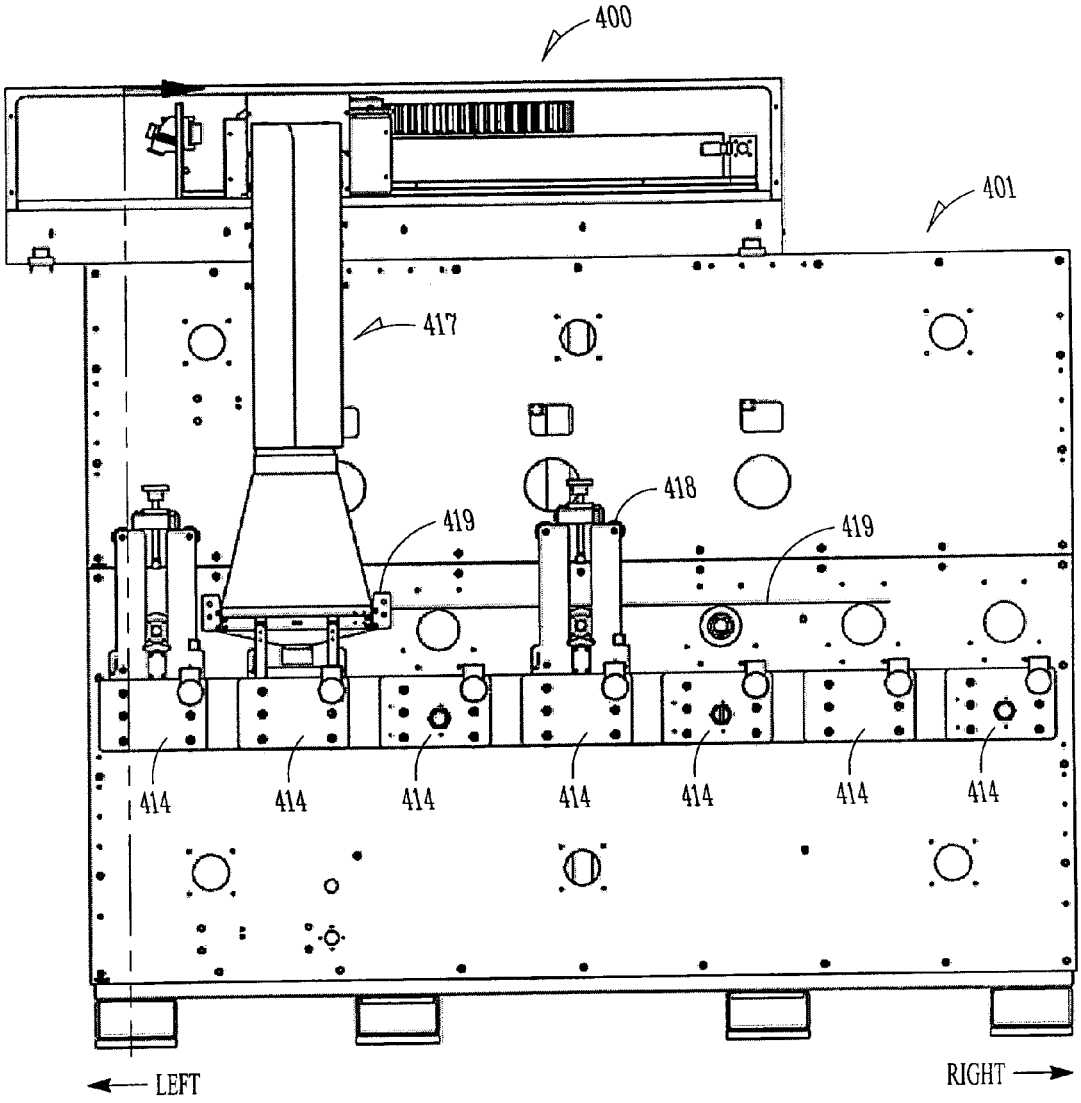

FIGS. 4A-4B illustrate a positioning apparatus according to an embodiment of the present subject matter. The illustrated positioning apparatus 400 is shown mounted to the top of a web processing machine 401. In various embodiments, web processing equipment 417 (inside cover) is mounted to a mount of the positioning apparatus 400. In various embodiments, the web processing machine 401 is adapted to use the web processing equipment 417 at one or more web processing stations 414. In the illustrated embodiment, the web processing machine 401 includes seven web processing stations 414. Three of the illustrated stations include web processing equipment including two modular die/nip stations 418 and a modular web cutting station 419 for use with laser web cutting equipment 417 mounted to the positioning apparatus 400. The web processing machine is adapted to process web 419 in a variety of configurations and the positioning apparatus 400 is adapted to position the web processing equipment 417 at one or more of the web processing stations 414 across the face of the web processing machine. For example, in the illustrated embodiment, the positioning apparatus 400 is adapted to position the web processing equipment 417 to any one of the five leftmost web processing stations 414 on the web processing machine 401. To position the web processing equipment 417 at a station, the positioning apparatus 400 includes a linear axis to move the equipment across the face of the machine and a rotary axis to rotate the apparatus in a vertical plane. In various embodiments, such as the one illustrated, the rotary axis allows the web processing equipment 417 to be rotated out of a path that would otherwise collide with other equipment mounted on the web processing machine. For example, in the illustrated embodiment, moving the web processing equipment 417 to the right from the illustrated position using only the linear axis would eventually cause the web processing equipment to interfere with one of the die/nip stations 418. Using the rotary axis, the web processing equipment 417 is rotated toward the top of the web processing machine 401 to avoid interference with the die/nip station 418. Web roll spindles and idlers rolls are examples of common web machine accessories mounted to the front of web processing machines in which a positioning apparatus according to the present subject matter uses the rotary axis to avoid when moving web processing equipment from one station to another.

Figure 5:
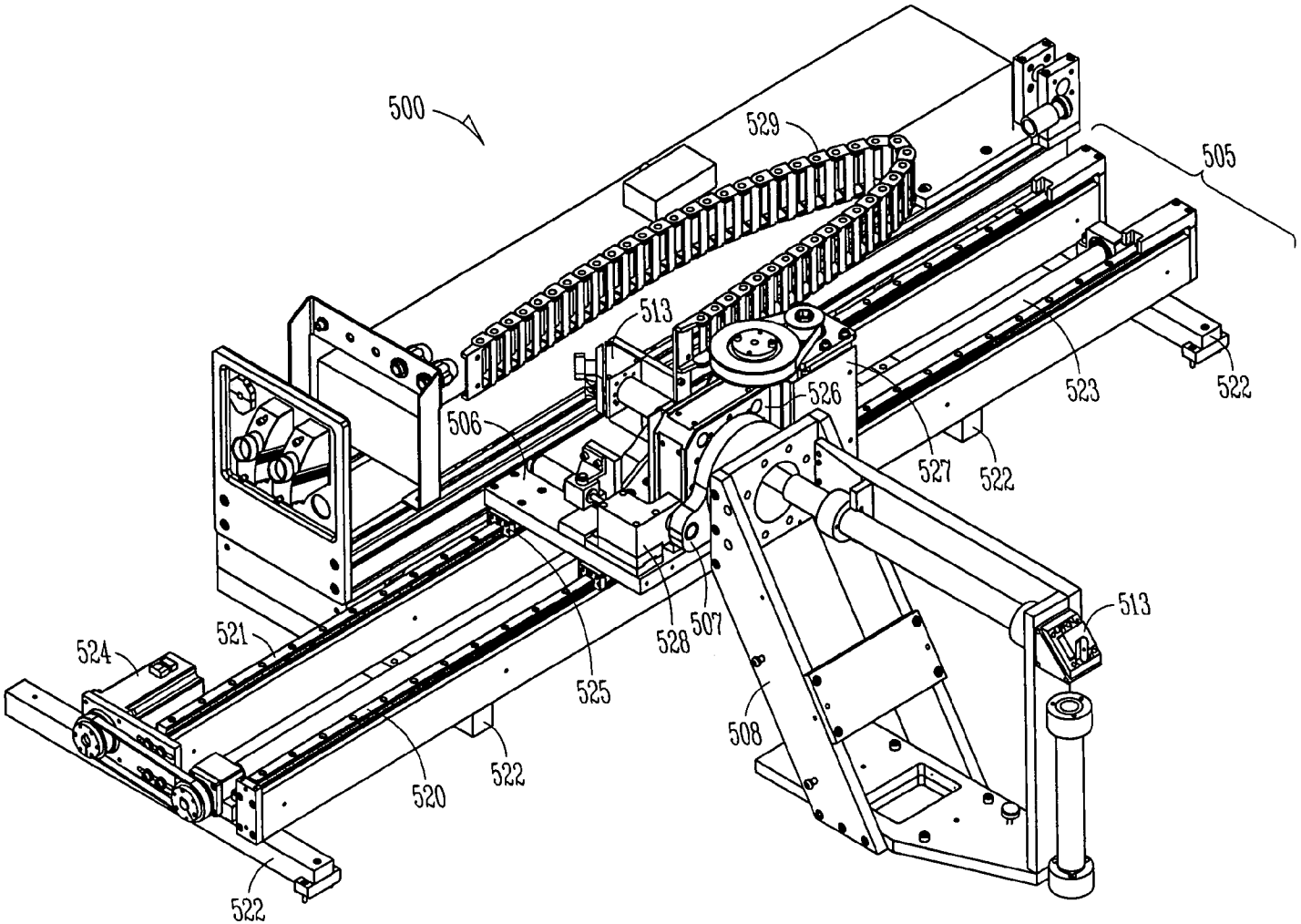
FIG. 5 illustrates a positioning apparatus according to an embodiment of the present subject matter.

FIG. 5 illustrates a positioning apparatus 500 according to an embodiment of the present subject matter. The positioning apparatus includes a linear axis 505, a carriage 506, a rotary axis 507 and a mount 508. In the illustrated embodiment, the linear axis 505 includes a first 520 and second 521 linear rail coupled to a plurality of mounts 522. A lead screw 523 is connected to two of the mounts 522 used to mount the positioning apparatus 500 to the web processing machine and positioned between the rails 520, 521. In the illustrated embodiment, the lead screw 523 is connected to a linear axis motor 524.

The carriage 506 is connected to a plurality of linear bearings 525 that ride along the rails 520, 521. The carriage 506 is also connected to the lead screw using a nut (not shown). The carriage 506 moves along the rails when the linear axis motor 524 rotates the lead screw 523. In various embodiments, the linear axis motor is a servo motor. Some embodiments use a linear servo motor connected to the carriage 506.

The rotary axis 507 is connected between the carriage 506 and the mount 508 and is used to rotate the mount. The rotary axis 507 includes a gearbox 526, a motor 527, a sensor (not shown) and a locating pin assembly 528. In various embodiments, the rotary axis motor 527 is a servo motor. The mount 508 is used to connect web processing equipment to the positioning apparatus 500. In various embodiments, web equipment includes a mobile portion connected to the mount 508 of positioning apparatus and a fixed portion located elsewhere. The positioning apparatus includes flexible ducting 529 to connect the fixed portion of the web processing equipment to the mobile portion connected to the mount. In the illustrated embodiment, a plurality of mirrors 513 are located on the positioning apparatus to guide a laser beam from a laser mounted to or near the web processing machine to a galvo assembly coupled to the mount 508 of the positioning apparatus 500.

Figure 6A:
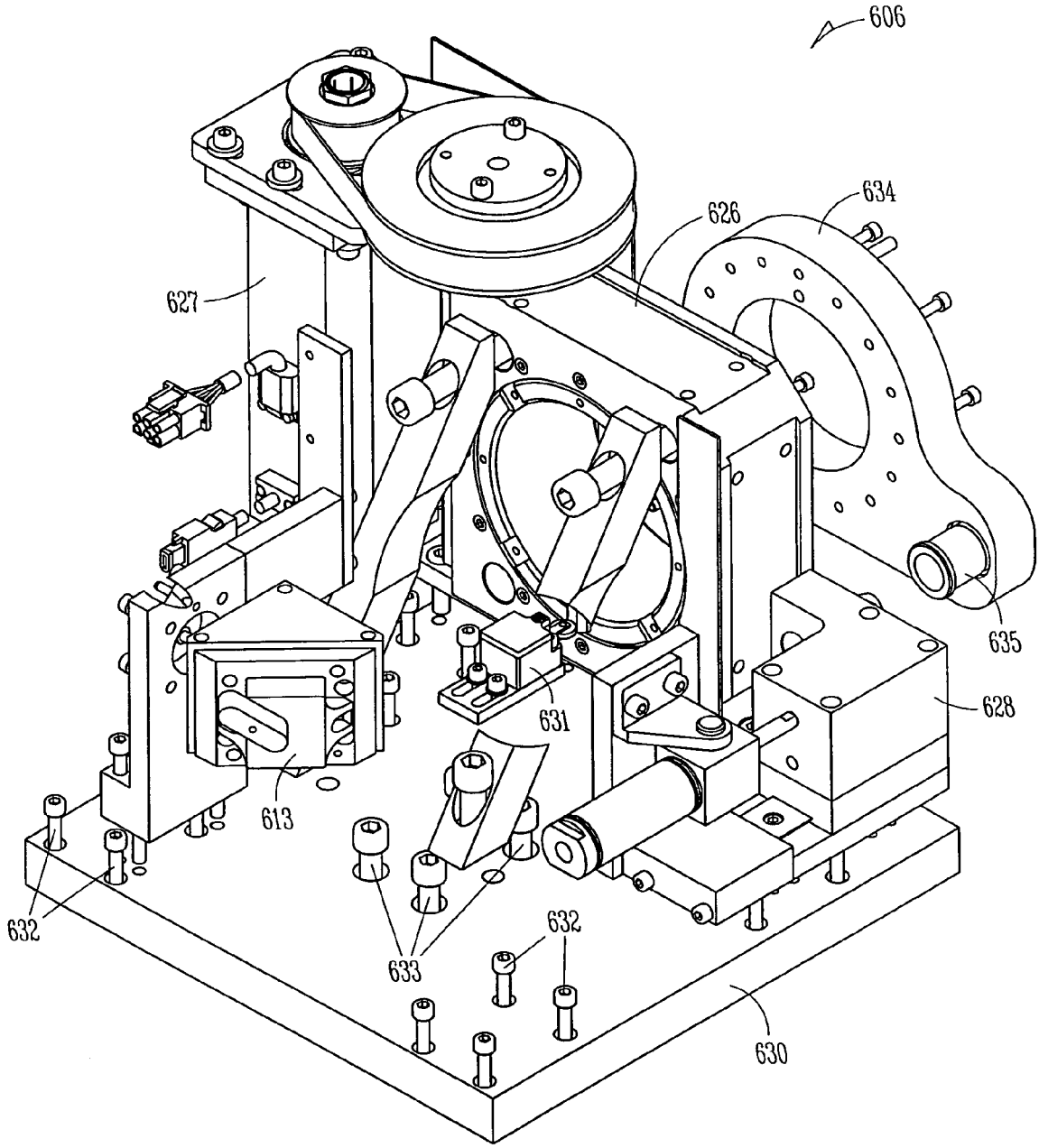
FIGS. 6A-6B illustrate a carriage for a positioning apparatus according to an embodiment of the present subject matter.
Figure 6B:
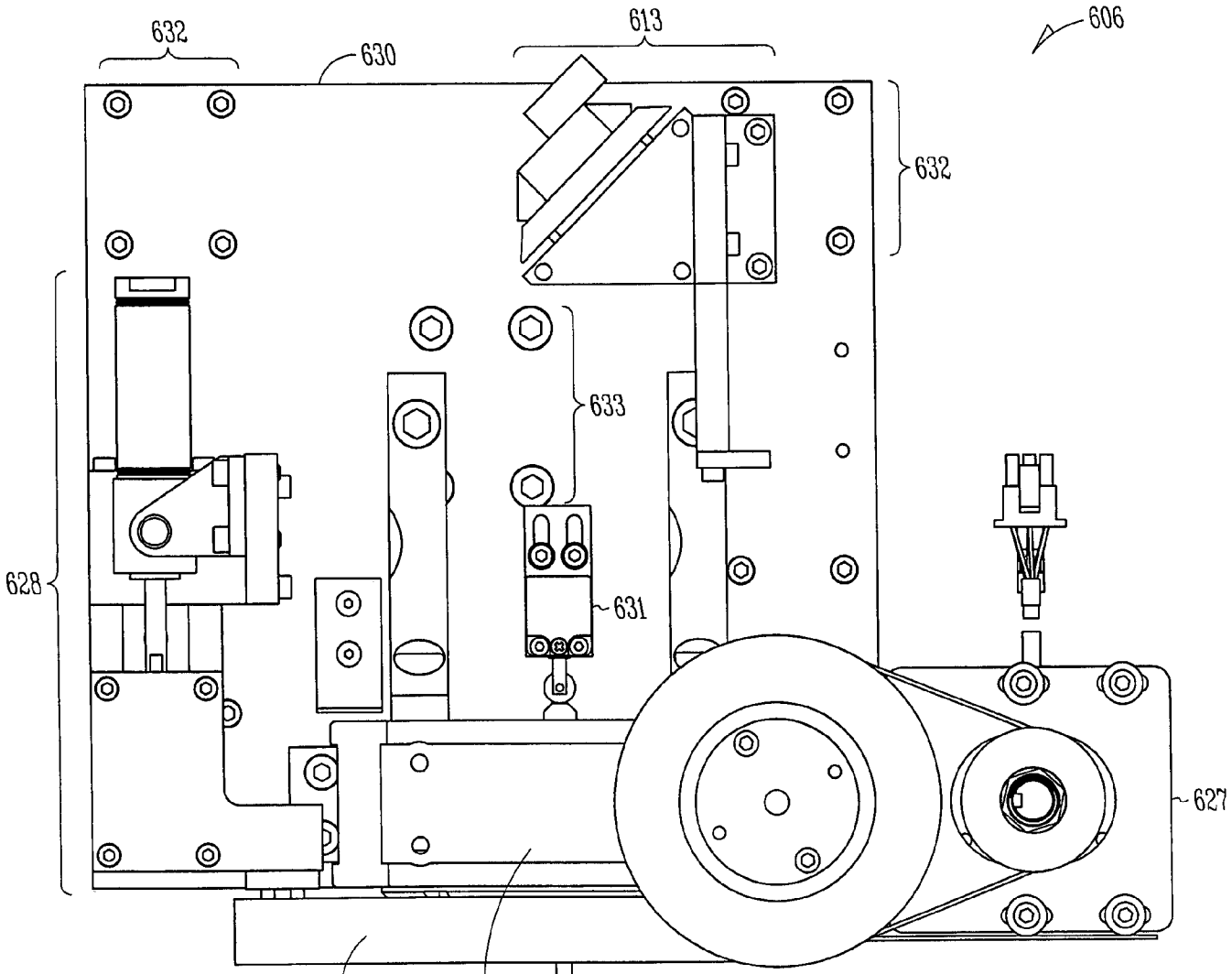

FIGS. 6A-6B illustrate a carriage 606 for a positioning apparatus according to an embodiment of the present subject matter. FIG. 6A is an isometric view of the carriage and FIG. 6B is a top view of the carriage. FIGS. 6A and 6B show a carriage base plate 630, a rotary gearbox 626 connected to a motor 627, a positioning pin assembly 628 and a position sensor assembly 631. In the illustrated embodiment, clearance holes and bolts 632 are shown for fastening the carriage base plate 630 to one of four linear bearings of the linear axis. A set of bolts 633 located near the center of the carriage base plate 630 connect the base plate to a nut assembly adapted to provide linear motion in cooperation with the lead screw of the linear axis. FIGS. 6A and 6B show an adapter plate 634 for attaching a mount to the rotary gearbox 626. In the illustrated embodiment, the adapter plate 634 includes a pin receiver opening 635 adapted to receive a positioning pin when the adapter plate 634 is at or near a predetermined rotary position. In various embodiments, the adapter plate 634 includes a plurality of pin receiver openings to accommodate fixing the adapter plate and attached mount at various predetermined rotary positions. The illustrated embodiment includes a mirror assembly 613 to direct a laser beam through the rotary gearbox 626 and the adapter plate 634.

Figure 7A:
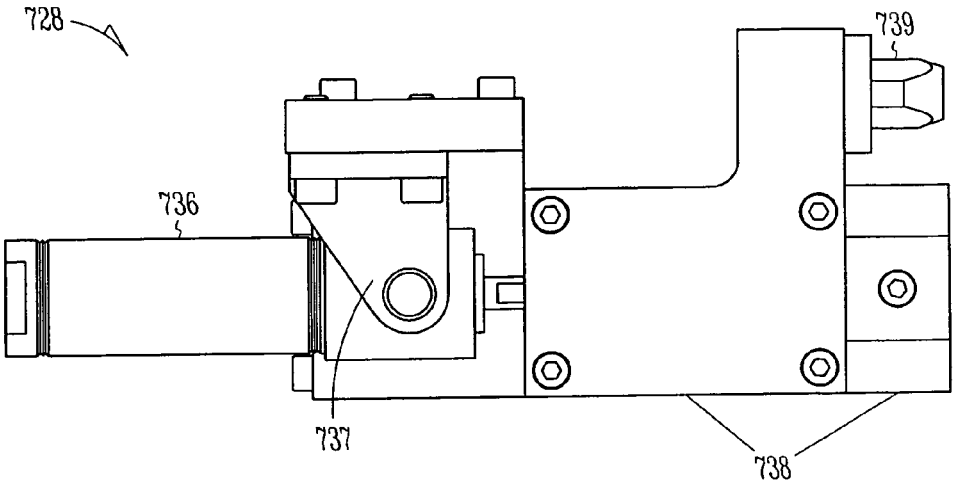
FIGS. 7A-7B illustrate a position pin assembly for a positioning apparatus according to an embodiment of the present subject matter.
Figure 7B:
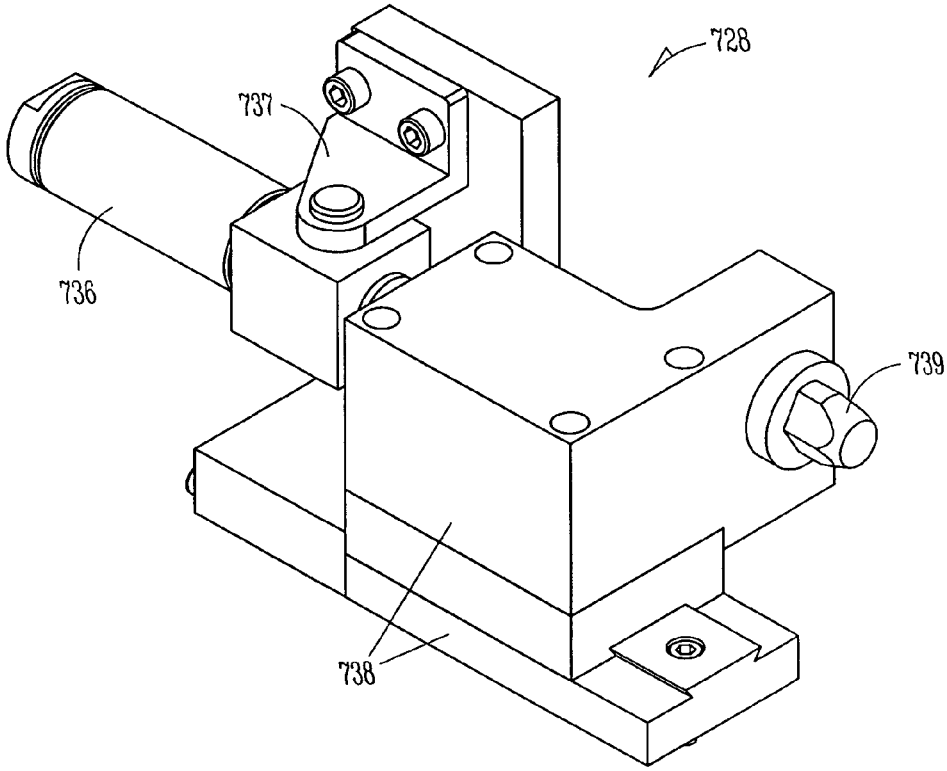

FIGS. 7A-7B illustrate a position pin assembly for a positioning apparatus according to an embodiment of the present subject matter. The position pin assembly 728 includes a pin 739, a slide assembly 738 and a pneumatic cylinder 736 and cylinder mount 737 for moving a portion of the slide assembly to engage and disengage the positioning pin with a rotary adapter plate.

Figure 8:
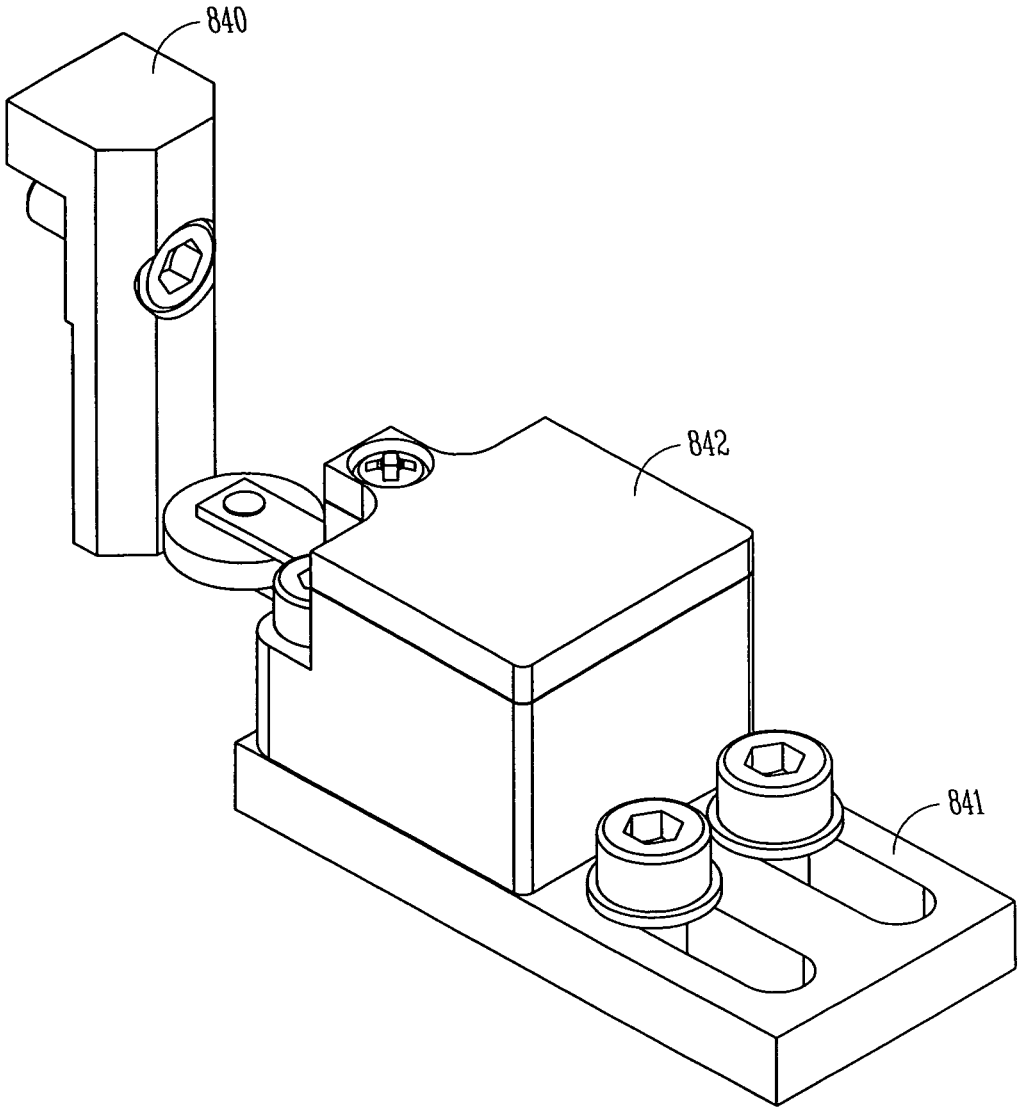
FIG. 8 illustrates a position sensor assembly for a positioning apparatus according to an embodiment of the present subject matter.

FIG. 8 illustrates a position sensor assembly for a positioning apparatus according to an embodiment of the present subject matter. The position sensor assembly includes a deflector 840, an adjustable sensor mount 841 and a sensor 842. The deflector 840 is mounted to and moves with a rotary adapter plate. The sensor 842 is mounted to the carriage of a positioning apparatus and is adjusted to trigger upon sensing the deflector 840. In various embodiments, the position sensor assembly provides an electrical signal for enabling and disabling web processing equipment coupled to the mount. In the illustrated embodiment, the position sensor assembly includes a mechanical limit switch. It is understood that various embodiments of the position sensor assembly can use other types of sensors, for example an optical sensor or a proximity sensor, without departing from the scope of the present subject matter.

Figure 9:
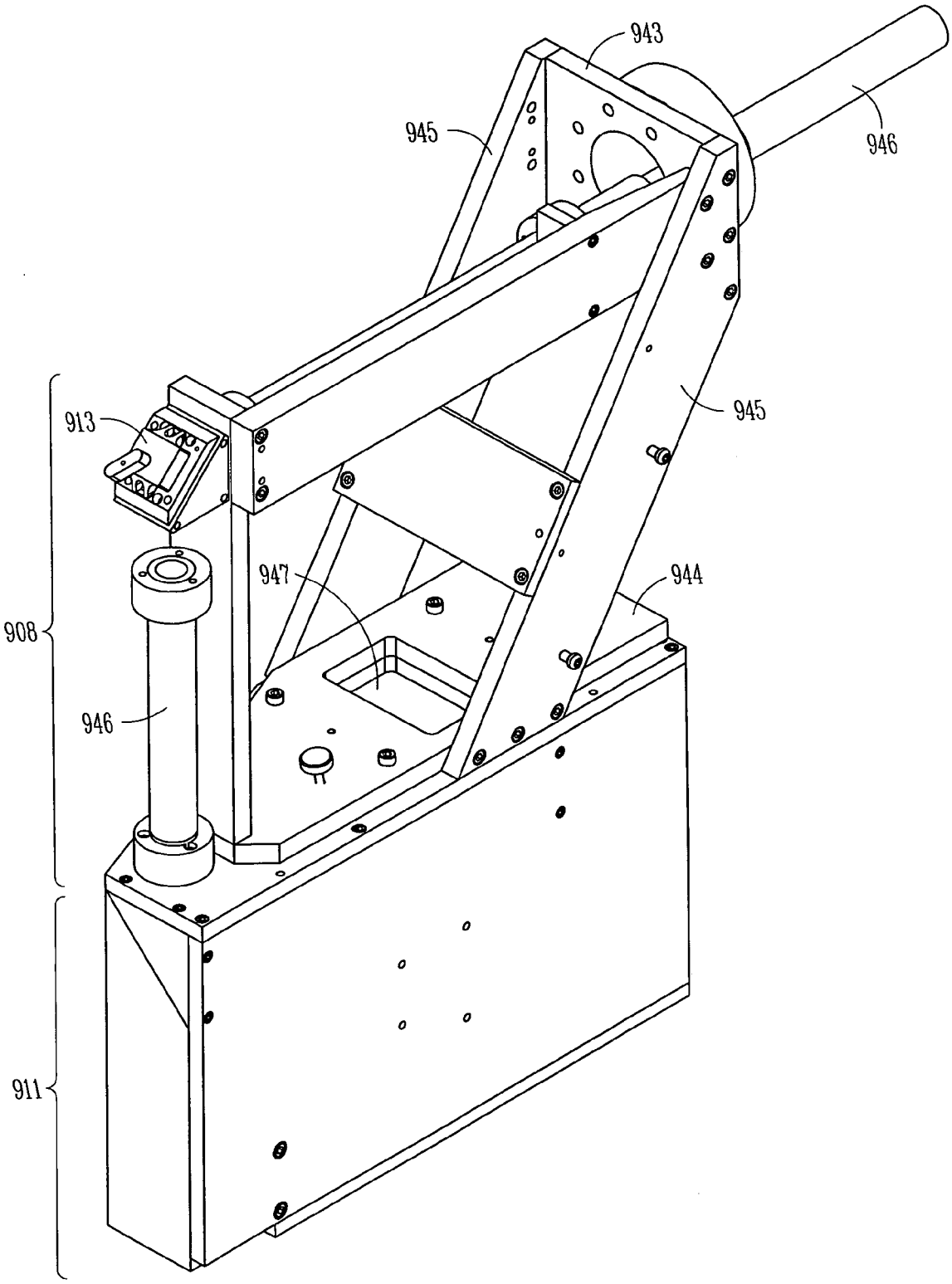
FIG. 9 illustrates a mount for a positioning apparatus according to an embodiment of the present subject matter.

FIG. 9 illustrates a mount 908 for a positioning apparatus according to an embodiment of the present subject matter. The illustrated mount includes an adapter mount plate 943, a equipment mount plate 944 and two support members 945 connecting the adapter mount plate 943 to the equipment mount plate 944. The illustrated mount includes an attached galvo assembly 911 and laser beam guidance components 946. The laser beam guidance components provide a laser beam path from the carriage to the galvo assembly. The equipment mount plate includes an opening 947 to provide utility access to the galvo assembly for electrical cabling and pneumatic tubing, for example. In various embodiments, the galvo assembly 911 provides multi-axis laser web cutting, web scoring, web ablation, control depth web cutting or combination thereof. The laser beam guidance components 946 guide a laser beam to the galvo assembly 911 from the carriage or a positioning apparatus. The illustrated embodiment includes guide tubes 946 and a mirror assembly 913. The mirror assembly 913 reflects a laser beam from the carriage toward the galvo assembly 911. The mirror assembly 913 includes adjustment controls to assist in directing the laser beam toward the galvo assembly 911.

FIG. 10 illustrates a operator terminal screen 1060 for controlling a positioning apparatus and attached web processing equipment according to one embodiment of the present subject matter. The screen includes both display and control elements. Control elements include pushbuttons and data entry controls. In various embodiments, the control elements can be activated using a mouse, a keyboard or a mouse and a keyboard. In various embodiments, the illustrated screen is displayed on a touch screen terminal allowing activation of a control element by touching the screen at the location of the control element.

The illustrated Laser Setup screen 1060 allows control and monitoring of a positioning apparatus with laser based web processing equipment attached to the mount. The Laser Control pushbutton 1061 toggles permissive signals enabling the laser. In various embodiments, the Laser Control pushbutton 1061 also enables and disables accessory equipment associated with the laser, such as, cooling equipment and exhaust equipment, for example. The Laser Mode pushbutton 1062 controls and displays the mode of laser with respect to the web processing machine with which the laser based web processing equipment is associate. In various embodiments, the Laser Mode is required to be in Auto mode before the web processing machine is allowed to begin processing web. In various embodiments, the Laser Mode is required to be in Manual mode before manual movement of the positioning apparatus is allowed.

The Current Station data display 1063, Laser Station data entry control 1064 and the Move to Station pushbutton 1065 allow controlled movement of web processing equipment attached to the positioning apparatus from one station to another. The Current Station data display 1063 shows the current position of the positioning apparatus relative to web processing stations located across the face of a web processing machine. The Laser Station data entry control 1064 allows an user to enter a destination station number for the positioning apparatus to move the attached web processing equipment to. Entry of a valid station number does not initiate motion of the positioning apparatus. In various embodiments, station "0" represents a predetermined destination that upon movement of the positioning apparatus moves the web processing equipment away from any of the web processing stations, for example, to a vertical position above the web processing stations. The Move to Station pushbutton 1065 initiates motion of the positioning apparatus from the positioning apparatus' current position to the position of the station entered using the Laser Station data entry control.

The Laser Setup screen 1060 includes displays and controls for individually operating the axes of the positioning apparatus. The illustrated Laser Setup screen 1060 allows individual operation of either the linear axis or the rotary, or "Arm", axis. The screen includes a Motor Enable/Disable pushbutton 1066, 1067, Position data display 1068,1069, Jog Speed data entry control 1070, 1071, reciprocal JOG pushbuttons 1072, 1073, 1074, 1075, and a Brake control pushbutton 1076, 1077 for each axis. The Motor Enable/Disable pushbutton 1066, 1067 triggers the controller to enable the axis motor if the axis is not enabled or disable the axis motor if the axis is enabled. Enabling an axis includes enabling motor drive amplifiers and closing the feedback loop of position controllers associated with the axis. In various embodiments, the linear axis includes a brake and enabling the linear motor includes releasing the linear axis brake. In various embodiments, the rotational axis includes a brake and enabling the rotational axis includes releasing the rotational axis brake. The Position Data displays 1068, 1069 show the value of a position counter of a position controller associated with each axis. In various embodiments, the position displayed is referenced to a predetermined reference position of each axis. In various embodiments, the position of the linear axis is displayed in metric units. In various embodiments, the position of the linear axis is displayed in English units. In various embodiments, the controller allows a user to change the displayed units of the linear axis between one or more English and Metric units.

The Jog Speed data entry controls 1070, 1071 display current jog speed of each axis and allow a new jog speed to be entered. The units of the jog speed are displayed distance units per second where the distance units are the same as the units of the position. The reciprocating Jog pushbuttons 1072, 1073, 1074, 1075 initiate movement of the corresponding axis in the direction indicated by the button. Movement will begin and continue as long as the button is pushed or until the axis reaches an predetermined or physical extreme of the axis' travel range. The Brake Control pushbuttons 1076, 1077 allow an axis brake to be disengaged without enabling the axis motor. In various situations, for example during setup, an technician may desire to move an axis by hand by pushing or pulling the axis. The Brake Control pushbutton 1076 1077 allows the technician to release the brake on an axis so the axis can be moved by hand.

The Zero Position pushbutton 1078 reset the position counter of all axes of the positioning apparatus to zero. The Zero Position pushbutton 1078 is used primarily during setup of the machine or in situation where the position counters are no longer accurate with respect to the web processing machine and mapped interference areas mapped thereon. Common where position counter inaccuracies an occur include replacement or repair of a position sensor. In various embodiments, one or more of the controls included on the Laser Setup screen 1060 are enabled based on a security setting associated with a user login.

This application is intended to cover adaptations and variations of the present subject matter. It is to be understood that the above description is intended to be illustrative, and not restrictive. The scope of the present subject matter should be determined with reference to the appended claim, along with the full scope of legal equivalents to which the claims are entitled.

What is claimed is:

1. An apparatus comprising:

a linear axis, including a first motor, mounted to a web processing machine;

a carriage adapted to linearly move on the linear axis, wherein the first motor is configured to move the carriage;

a rotary axis, including a second motor, connected to the carriage;

a mount connected to the rotary axis, wherein the second motor is configured move the mount about the rotary axis and the mount is adapted to mount web processing equipment to process web; and a controller adapted to control the first motor and the second motor to move the mount between at least two web processing stations on the web processing machine, wherein in moving the mount between at least two web processing stations, the controller is adapted to execute a plurality of moves using the first motor in conjunction with a plurality of moves using the second motor according to a motion profile to avoid interferences on the web processing machine while moving the mount between the at least two web processing stations.

2. The apparatus of claim 1, wherein the second motor is a servo motor adapted to rotate the rotary axis.

3. The apparatus of claim 1, further comprising a positioning pin assembly connected to the linear axis, the positioning pin assembly adapted to retain the rotary axis in a predetermined position.

4. The apparatus of claim 1, wherein the linear axis includes a first linear rail and a second linear rail connected to the web processing machine.

5. The apparatus of claim 1, wherein the rotary axis includes a rotary gearbox.

6. A system for guiding a laser beam to a laser head to process web handled by a web processing machine, the system comprising:

a positioning apparatus mounted to the web machine and adapted to move the laser head from one web processing station into operational position at another web processing station, the positioning apparatus comprising:

a linearly movable carriage;

a mount rotatably coupled to the carriage;

a mirror mounted to the carriage and in a path of the laser beam, wherein the mirror is adapted to direct the laser beam to the mount, and the mount is adapted to direct the laser beam to the laser head coupled to the mount; and a controller connected to the positioning apparatus for controlling linear movement of the carriage and the rotational movement of the mount, wherein the controller is configured to execute a plurality of moves of the carriage and the mount according to a programmed motion profile to avoid interferences moving the laser head between the web processing stations.

7. The system of claim 6, further comprising a gearbox coupling the mount to the carriage.

8. The system of claim 7, further comprising a motor connected to the gearbox.

9. The system of claim 8, wherein the motor is a servo motor.

10. The system of claim 6, further comprising a linear axis assembly adapted to move the carriage.

11. The system of claim 10, wherein the linear axis assembly comprises a first and second linear rail connected to the carriage using a plurality of linear bearings.

12. The system of claim 11, wherein the linear axis assembly includes a servo motor coupled to the carriage.

13. The system of claim 10, wherein the linear axis assembly includes:

a servo nut connected to the carriage;

a lead screw coupled to the servo nut; and a motor connected to the lead screw.

14. The system of claim 13, wherein the motor is a servo motor.

15. A method of moving web equipment from a first web processing station to a second web processing station, the method comprising:

raising the web equipment away from the first web processing station, wherein raising includes rotating the web equipment about a rotary axis;

linearly moving the rotary axis along a linear axis; and lowering the web equipment toward the second web processing station, wherein lowering includes rotating the web equipment about the rotary axis, wherein raising further includes linearly moving the rotary axis in conjunction with rotating the web equipment about the rotary axis as part of a motion profile to raise the web equipment away from the first web processing station.

16. The method of claim 15, wherein lowering further includes linearly moving the rotary axis in conjunction with rotating the web equipment about the rotary axis as part of a motion profile to lower the web equipment toward the second web processing station.

17. The method of claim 15, wherein the web equipment includes a laser head connected to the rotary axis by a mount with a laser beam path, the method further comprising:

directing a laser beam parallel with the linear axis to the rotary axis; and directing the laser beam into the laser beam path of the mount to the laser head.

18. A method of moving web equipment from a first web processing station to a second web processing station, the method comprising:

disengaging one or more axis brakes of a positioning apparatus having one or more axes;

disengaging a positioning pin to unlock one of the one or more axes;

implementing a motion profile to avoid interferences moving the web processing equipment from the first web processing station to the second web processing station;

executing a plurality of moves of the one or more axes according to the motion profile;

engaging the positioning pin to lock one of the one or more axes; and engaging one or more axis brakes of the positioning apparatus.

19. The method of claim 18, wherein executing a plurality of moves includes executing a rotational move to raise the web processing equipment away from the first web processing station, and executing a rotational to lower the web processing equipment toward the second web processing station.

20. The method of claim 18, wherein executing a plurality of moves includes executing one or more interpolated moves to raise the web processing equipment away from the first web processing station or tower the web processing equipment toward the second web processing station.

21. A method of moving web equipment from a first web processing station to a second web processing station, the method comprising:

raising the web equipment away from the first web processing station, wherein raising includes rotating the web equipment about a rotary axis;

linearly moving the rotary axis along a linear axis; and lowering the web equipment toward the second web processing station, wherein towering includes rotating the web equipment about the rotary axis, wherein lowering further includes linearly moving the rotary axis in conjunction with rotating the web equipment about the rotary axis as part of a motion profile to lower the web equipment toward the second web processing station.

22. The method of claim 21, wherein the web equipment includes a laser head connected to the rotary axis by a mount with a laser beam path, the method further comprising:

directing a laser beam parallel with the linear axis to the rotary axis; and directing the laser beam into the laser beam path of the mount to the laser head.

* * * * *

UNITED STATES PATENT AND TRADEMARK OFFICE

CERTIFICATE OF CORRECTION

PATENT NO. : 8,436,272 B2
APPLICATION NO. : 12/058335
DATED : May 7, 2013
INVENTOR(S) : Schiebout It is certified that error appears in the above-identified patent and that said Letters Patent is hereby corrected as shown below:

In the Claims

In column 8, line 49, in Claim 1, before “move”, insert --to--, therefor

In column 10, line 37, in Claim 20, delete “tower” and insert --lower--, therefor In column 10, line 47, in Claim 21, delete “towering” and insert --lowering--, therefor Signed and Sealed this
Third Day of September, 2013

Teresa Stanek Rea
*Acting Director of the United States Patent and Trademark Office*